US010107207B2

(12) United States Patent
Li et al.

(10) Patent No.: US 10,107,207 B2
(45) Date of Patent: Oct. 23, 2018

(54) SMALL ENGINE COMBINATION SWITCH

(71) Applicant: HANGZHOU POWER YOUNG TECHNOLOGY CO. LTD, Hangzhou (CN)

(72) Inventors: Jie Li, Hangzhou (CN); Longxin Tang, Hangzhou (CN)

(73) Assignee: HANGZHOU POWER YOUNG TECHNOLOGY CO. LTD, Hangzhou (CN)

( * ) Notice: Subject to any disclaimer, the term of this patent is extended or adjusted under 35 U.S.C. 154(b) by 79 days.

(21) Appl. No.: 15/232,817

(22) Filed: Aug. 10, 2016

(65) Prior Publication Data

US 2018/0045124 A1 Feb. 15, 2018

(51) Int. Cl.
*F02D 11/04* (2006.01)
*F02D 11/02* (2006.01)

(52) U.S. Cl.
CPC ..... *F02D 11/04* (2013.01); *F02D 11/02* (2013.01)

(58) Field of Classification Search
CPC ..... F02D 11/04; F02D 11/02
USPC ..... 123/198 BD
See application file for complete search history.

(56) References Cited

U.S. PATENT DOCUMENTS 5,590,554 A * 1/1997 Ho ..... E05B 13/101 70/218
2007/0234998 A1* 10/2007 Kinoshita ..... F02B 77/08 123/198 D
2008/0302325 A1* 12/2008 Reed ..... F02M 3/00 123/179.18
2015/0233311 A1* 8/2015 Repasky ..... F02D 33/003 123/332

* cited by examiner

*Primary Examiner* — Joseph Dallo
*Assistant Examiner* — Yi-Kai Wang
(74) *Attorney, Agent, or Firm* — Global IP Services; Tianhua Gu

(57) ABSTRACT

The invention relates generally to portable internal combustion engine powered devices. Public a small engine control combination switch comprising a knob assembly, a bracket and a choke cable, knob assembly includes a fixed plate, characterized in that the fixed plate with a rail; the bracket including a first hole. The choke cable connects with the rail through the first hole. The height of the rail is gradually increased, rail pivot drives the choke cable on the top of the track moves up and down; also further includes a fuel switch, a fixed plate is provided with a rotating shaft, the shaft connecting the fuel switch. The invention through the choke point of engine control, start-up, operation and shut down control, which simplifies the traditional steps of engines, generators and other equipment, greatly simplifying the operation process, improving the operation efficiency.

2 Claims, 4 Drawing Sheets

SMALL ENGINE COMBINATION SWITCH

TECHNICAL FIELD

The invention relates generally to portable internal combustion engine.

BACKGROUND OF THE INVENTION

Currently, such as gasoline, diesel oil, natural gas, liquefied petroleum gas as fuel in small engine and driven equipment mainly for hospitals, hotels, families, urban construction, environmental protection and other fields to provide temporary power supply, mobile power and special machinery.

The choke, the fuel switch, the ON/OFF switch is generally designed to separate on small engine and driven equipment, so you need first to open the ON/OFF switch, adjust the choke position and open the fuel switch after by manual or electric to start the engine. The need for timely open choke when the engine is started; close the ON/OFF switch and fuel switch when the engine is turned off, if the user forget to shut down fuel switch may lead to leakage and fire hazard risk. If you don't use engine or equipment for a long time, you need to use the tool to manually put off the inside of the carburetor fuel, otherwise it will corrode the carburetor fuel, and will be corroded in the carburetor, cement plug carburetor. So the main drawback of conventional engines or equipment is very complicated operation, inefficient operation.

SUMMARY OF THE INVENTION

The technology of the invention in view of the existing operation cumbersome and inefficient, provides a small engine control combination switch.

In order to solve the technical problems, the invention through the following technical scheme:

A small engine control combination switch comprising: a knob assembly, a bracket and a choke cable, the knob assembly includes a fixed plate, characterized in that the fixed plate with a rail; and the bracket including the first hole. The choke cable through the first hole connected with the rail, the height of the rail is gradually increased, rail pivot drives the choke cable on the top of the track moves up and down.

Preferred, also further includes fuel switch, fixed plate with a rotating shaft is provided with a second hole on the bracket, putting the rotating shaft into the second hole, and is connected with the fuel switch, rotating the rotating shaft 102 to drive the fuel switch on or off.

Preferred, the fixed plate includes the convex block, and the ON/OFF switch is arranged on the bracket which is matched with convex block to control the engine.

Preferred, also further includes a choke wire guide, the choke cable is in the choke wire guide, and the choke wire guide is provided on the bracket.

Preferred, with a stopper plate on fuel switch, the spring is arranged on the stopper plate, the steel ball is arranged on the spring; the groove in the fixed plate, which is matched with the steel ball, and the outer diameter of the ball 8 is larger than the pore diameter of the groove.

Preferred, a rotating part is arranged on the fixed plate.

Preferred, the bracket is provided with a panel, and the knob assembly is arranged in the panel.

The invention with the above technical scheme, has significant technical effect:

1. The invention only rotating the knob assembly can achieve to control the choke, the fuel switch and the ON/OFF switch, greatly simplifying the operation process, improving the operation efficiency.

2. The invention increases the function of burning residual fuel in the carburetor, so you do not need to manually by way of dumping, which can prevent of the engine unused for long time leading to corrosion of fuel to the carburetor, and the oil deterioration causes the blockage of the carburetor.

3. The invention has the advantages of simple and compact structure, convenient operation, safety and reliability, and is widely used in small engines and driven equipment.

Above the drawings illustrate of each parts of the digital label refers to the following: 1—knob assembly, 101—rail, 102—rotating shaft, 103—groove, 104—fixed plate. 105—convex block, 106—rotating part, 2—bracket, 201—first hole, 202—second hole, 3—nut, 4—choke cable, 41—choke wire guide, 5—fuel switch, 6—stopper plate, 7—spring, 8—steel ball, 9—ON/OFF switch, 10—panel.

DETAILED DESCRIPTION OF THE EMBODIMENT

Reference is made to the accompanying drawings in which is shown an illustrative embodiment of the invention from which its features and advantages will be apparent.

An Embodiment of the Invention

Figure 1:
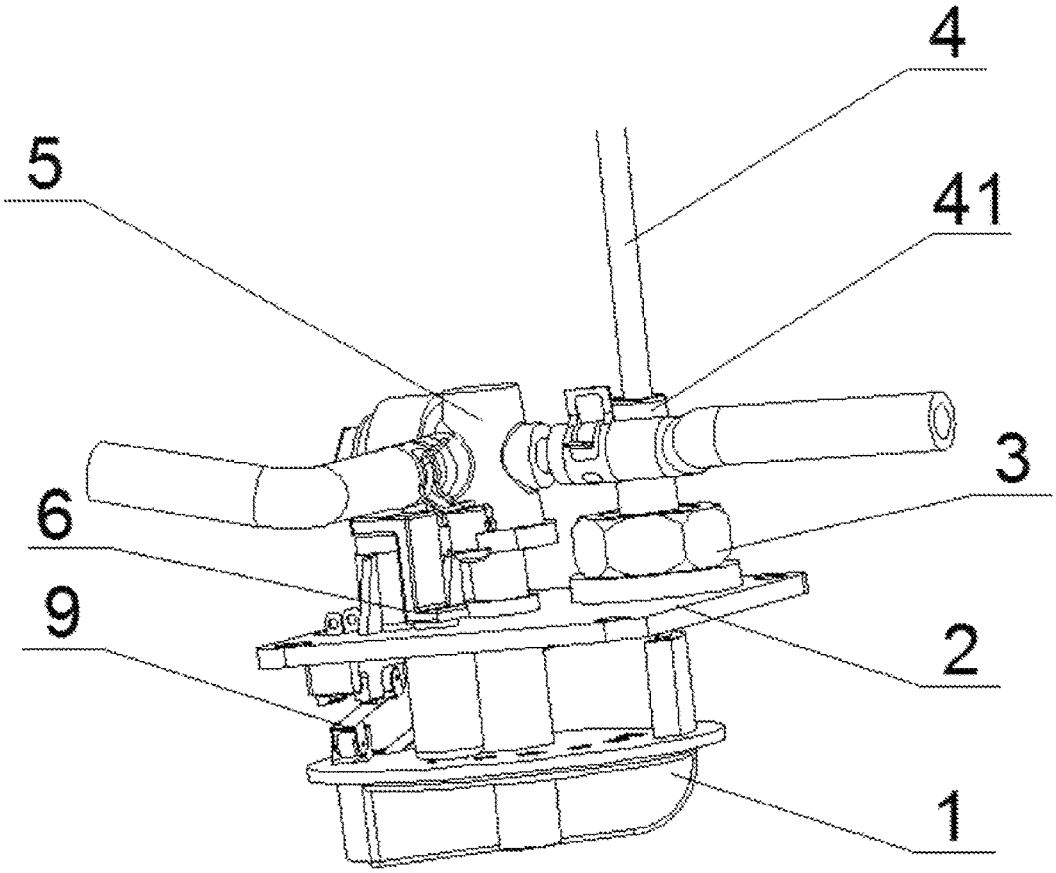
FIG. 1 is a schematic view of the structure of the present invention.
Figure 2:
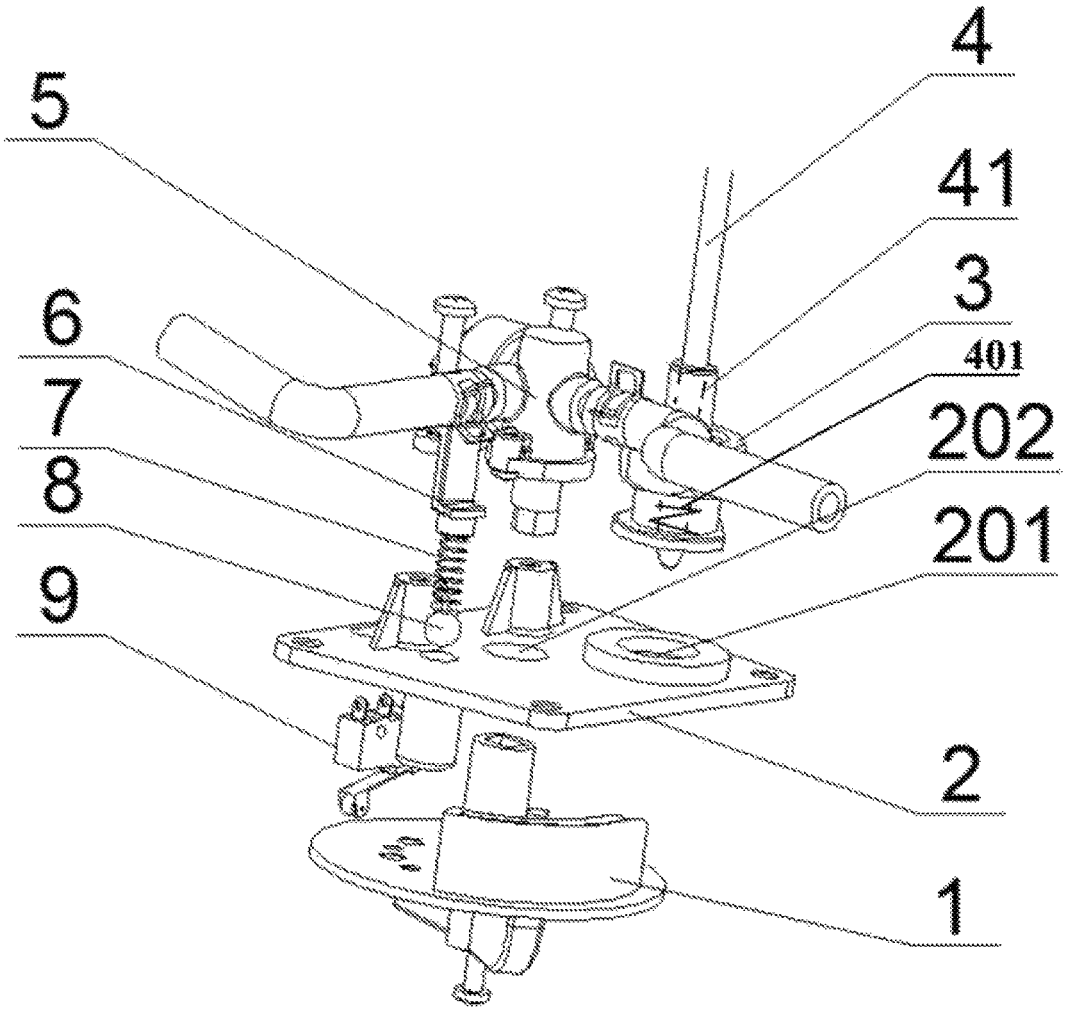
FIG. 2 is an exploded view of the present invention.
Figure 3:
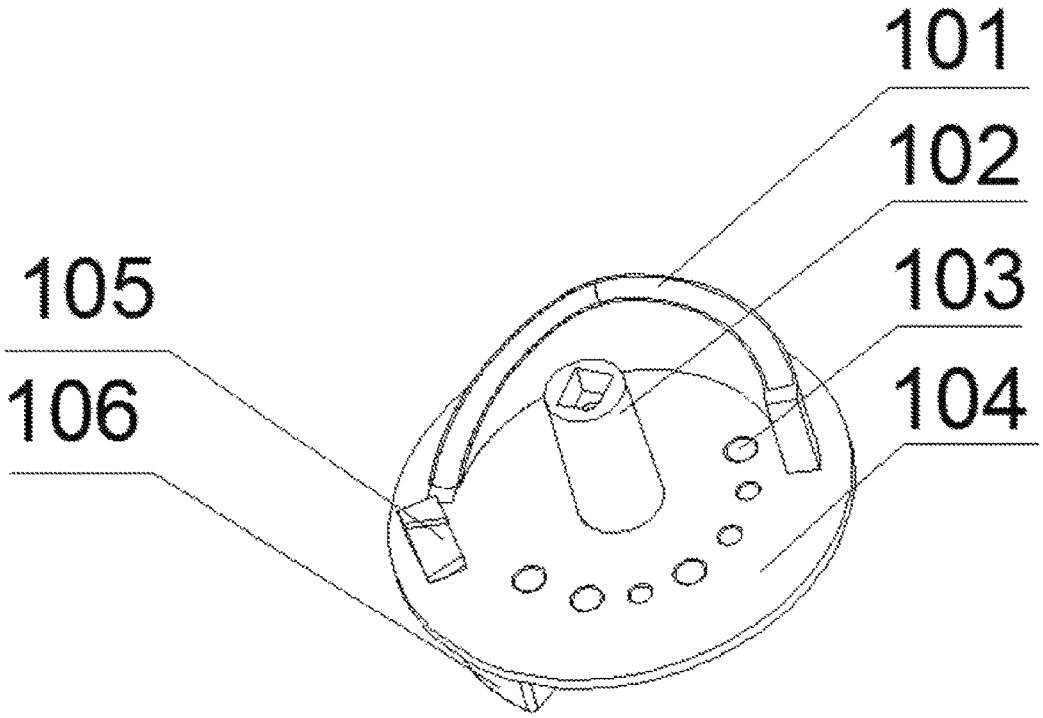
FIG. 3 is a schematic view of knob component shown in FIG. 1.
Figure 4:
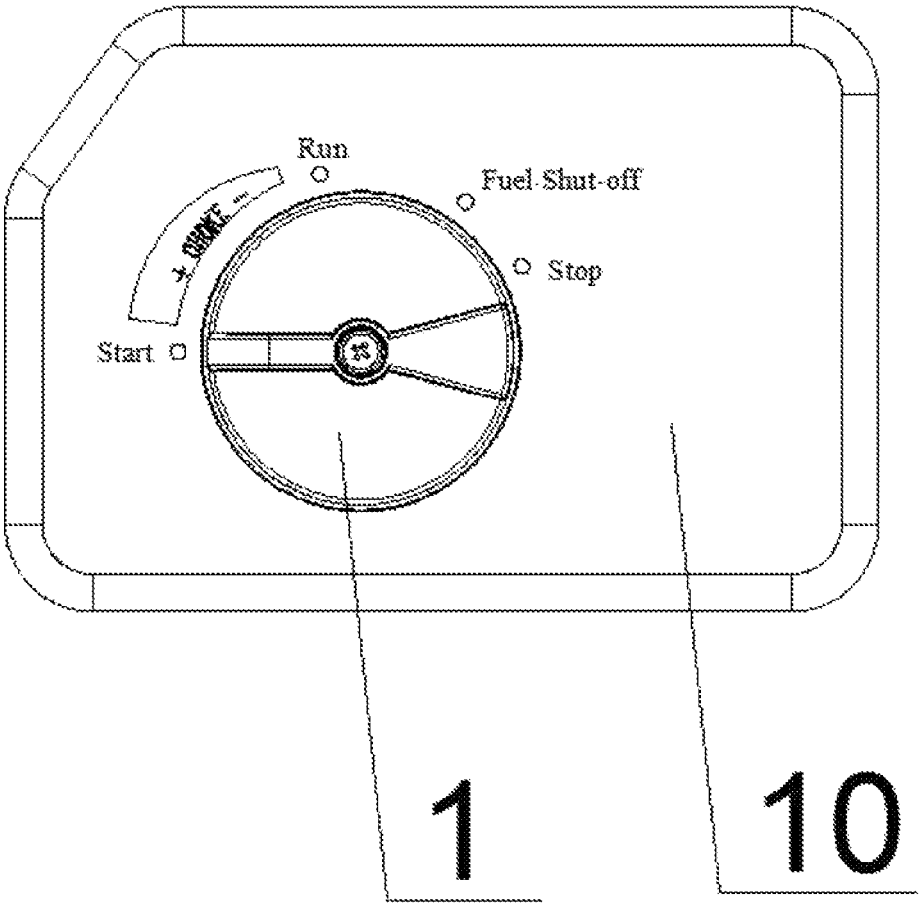
FIG. 4 is a schematic view of the structure of the panel.

A small engine control combination switch shown in FIGS. 1-4 knob assembly I, bracket 2 and choke cable 4, knob assembly I includes fixed plate 104, characterized in that fixed plate 104 with rail 101; and bracket 2 including first hole 20. Choke cable 4 through first hole 20 I connected with rail 101, the height of the rail 101 is gradually increased, rail 101 pivot drives choke cable on the top of the track moves up and down. Also further includes choke wire guide 41, choke cable 4 is in choke wire guide 41, and choke wire guide 41 is provided on bracket 2. A reset spring 401 is installed at the end of choke cable 4 making the point of choke cable 4 and rail 101 is always kept in contact, Slide on rail 101 to realize telescopic choke cable 4, so as to control the choke opening and closing.

Also further includes fuel switch 5, fixed plate 104 with rotating shaft 102 is provided with second hole 202 on bracket 2, turn rotating shaft 102 into second hole 202, rotating shaft 102 to connect fuel switch 5, rotating shaft 102 rotates to control fuel switch 5.

Bracket 2 is provided with panel 10 and knob assembly 1 is set within panel 10, panel 10 marked "Start", "Run" and "Run Out Of Fuel" and "Stop" font of labels.

Fixed plate 104 includes convex block 105, and ON/OFF switch 9 is arranged on bracket 2. When convex block 105 and ON/OFF switch 9 are in contact, ON/OFF switch 9 is turned on, so turn off the engine.

With stopper plate 6 on fuel switch 5, spring 7 is arranged on stopper plate 6, steel ball 8 is arranged on spring 7; groove 103 in fixed plate 104, which is matched with steel ball 8, and the outer diameter of ball 8 is larger than the pore diameter of groove 103. Rotating part 106 is arranged on fixed plate 104, rotating fixed plate 104 can increase the feeling when the user turns knob assembly 1.

Operation Process as Follows:

1. Starting Position

When knob assembly 1 in an initial position, that is, in the "Start" position, fuel switch 5 has been partially open, the choke in a fully closed state, ON/OFF switch 9 is off state, rotating knob assembly 1 within the scope from the "Start" to "Run", fuel switch 5 and the choke gradually opened to the maximum position, arbitrary positions within this range, the operator can manual or electric to start the engine motor according to environmental conditions.

2. Operating Position

Rotary knob assembly 1 to "Run" position, at this time the choke and fuel switch 5 fully open, when the engine is in the operating phase.

3. Storage Position

Continue rotating knob assembly 1, when fuel switch 5 out of fuel slowly decrease, keeping the choke fully open. When the users don't plan to use the engine for a long time, can be rotated to the "Run Out Of Fuel" position where fuel switch 5 is fully closed, the choke valve remains fully open, the engine continues to run, when the carburetor fuel burn, engine turn off, thus avoiding the use of tools to manually put the oil, simplifies operation.

4. Stop Position

Continued rotation knob assembly 1 to "Stop" position, then ON/OFF switch 9 is contacted by convex block 105 on knob assembly 1, ON/OFF switch 9 is turned on, which causes the engine flameout, and the device stops running.

The invention overcomes the defects of the prior art, only rotating the knob assembly can realize the choke, fuel switch 5, ON/OFF switch 9 control, simplifying the operation process, improving the operating efficiency; and increases the function of burning residual fuel in the carburetor, so you do not need to manually by way of dumping, which can prevent of the engine unused for long time leading to corrosion of fuel to the carburetor, and the oil deterioration causes the blockage of the carburetor.

The principles and features of this invention may be employed in various and numerous embodiments without departing from the scope of the invention.

The invention claimed is:

1. A small engine control combination switch, comprising:

a fuel switch;

a bracket having a first hole and second hole;

a knob assembly comprising a fixed plate, a rotating shaft which passes through the second hole to connect with the fuel switch for driving the fuel switch on or off;

a engine controlling means comprising a convex block on the fixed plate, an ON/OFF switch arranged on the bracket, the ON/OFF switch is matched with the convex block to control the engine;

a coke controlling means comprising a rail on the fixed plate, a choke wire guide is provided on the bracket, a choke cable is in the choke wire guide and passes the first hole to contact with the rail, a reset spring is installed at an end of the choke cable for making the end of the choke cable to keep touch on the rail, the rail is gradually increased in height, when the fix plate of the knob assembly is turned the rail is turned too, thereby the rail drives the choke cable to move up and down to control the coke;

the Bracket is provided with a panel and the knob assembly is set within the panel 10, panel 10 is marked labels of Start, Run, Run Out of Fuel and Stop;

when the knob assembly is in the Start position, the fuel switch 5 has been partially open, the choke in a fully closed state, the ON/OFF switch 9 is off state;

when the knob assembly is within a scope from the Start to Run, the fuel switch and the choke gradually opened to the maximum position, arbitrary positions within this range;

when the knob assembly is in the Run position, the choke and fuel switch fully open;

when knob assembly is in the Fuel Shut-off position, the fuel switch is fully closed, the choke valve remains fully open, the engine continues to run, carburetor fuel is burnt, thus avoiding use of tools to manually put the carburetor fuel out;

when the knob assembly is in the Stop Position, the ON/OFF switch is contacted by the convex block to be turned on to make the engine flameout.

2. The small engine control combination switch according to claim 1, wherein with a stopper plate is on the fuel switch, a spring is arranged on the stopper plate, a steel ball is arranged on the spring, a plurality of grooves are in the fixed plate, which are matched with the steel ball respectively, and an outer diameter of the steel ball is larger than a pore diameter of the groove.

* * * * *